US010072445B2

(12) United States Patent
Barmscheidt

(10) Patent No.: US 10,072,445 B2
(45) Date of Patent: Sep. 11, 2018

(54) MOTOR VEHICLE DOOR LOCK

(71) Applicant: Kiekert Aktiengesellschaft, Heiligenhaus (DE)

(72) Inventor: Christian Barmscheidt, Duisburg (DE)

(73) Assignee: Kiekert Aktiengesellschaft, Helligenhaus (DE)

( * ) Notice: Subject to any disclaimer, the term of this patent is extended or adjusted under 35 U.S.C. 154(b) by 348 days.

(21) Appl. No.: 14/443,731

(22) PCT Filed: Nov. 22, 2013

(86) PCT No.: PCT/DE2013/000702

§ 371 (c)(1),
(2) Date: Jun. 24, 2015

(87) PCT Pub. No.: WO2014/079412

PCT Pub. Date: May 30, 2014

(65) Prior Publication Data

US 2015/0300052 A1 Oct. 22, 2015

(30) Foreign Application Priority Data

Nov. 22, 2012 (DE) ..... 10 2012 111 288

(51) Int. Cl.
*E05B 79/10* (2014.01)
*E05B 81/14* (2014.01)
(Continued)

(52) U.S. Cl.
CPC ..... *E05B 79/10* (2013.01); *E05B 77/02* (2013.01); *E05B 81/14* (2013.01); *E05B 85/243* (2013.01);
(Continued)

(58) Field of Classification Search
CPC ..... E05B 81/06; E05B 77/28; E05B 77/26; E05B 77/44; Y10T 292/1082
(Continued)

(56) References Cited

U.S. PATENT DOCUMENTS 5,887,466 A * 3/1999 Yoshizawa ..... B60R 25/1001 292/201
6,364,378 B1 * 4/2002 Humbert ..... E05B 77/26 292/201
(Continued)

FOREIGN PATENT DOCUMENTS

EP 0828049 A2 3/1998
WO WO 02/31298 A1 4/2002
(Continued)

OTHER PUBLICATIONS

Machine Translation by Lexis Nexis Total Patent of EP0828049A2 on Jun. 18, 2015.
(Continued)

*Primary Examiner* — Mark A Williams
(74) *Attorney, Agent, or Firm* — Woodard, Emhardt, Moriarty, McNett & Henry LLP

(57) ABSTRACT

The object of the present invention is a motor vehicle door lock, comprising a locking mechanism and an electrical drive for electrically opening the locking mechanism. According to the invention, a complementary drive is provided in addition to the electrical drive for electrically opening the locking mechanism. With the aid of the electrical drive, the additional drive releases, for the purpose of electrically opening the locking mechanism, a mechanical safety mechanism of the respective electrical drive, which is formed by a blocking element.

17 Claims, 3 Drawing Sheets

(51) Int. Cl.

| | |
|---|---|
| ***E05B 77/02*** | (2014.01) |
| ***E05B 85/24*** | (2014.01) |
| *E05B 77/26* | (2014.01) |
| *E05B 77/28* | (2014.01) |
| *E05B 81/06* | (2014.01) |

(52) U.S. Cl.
CPC ..... *E05B 77/26* (2013.01); *E05B 77/28* (2013.01); *E05B 81/06* (2013.01)

(58) Field of Classification Search
USPC ..... 292/201
See application file for complete search history.

(56) References Cited

U.S. PATENT DOCUMENTS

| | | | | |
|---|---|---|---|---|
| 6,764,113 | B1 * | 7/2004 | Cetnar | E05B 81/06 292/201 |
| 2001/0035654 | A1 * | 11/2001 | Cetnar | E05B 77/26 292/201 |
| 2003/0116977 | A1 * | 6/2003 | Erices | E05B 81/06 292/201 |
| 2003/0164616 | A1 * | 9/2003 | Belmond | E05B 77/12 292/201 |
| 2004/0195845 | A1 * | 10/2004 | Chevalier | E05B 77/48 292/201 |
| 2004/0232707 | A1 * | 11/2004 | Kachouh | E05B 81/14 292/216 |
| 2011/0214460 | A1 * | 9/2011 | Byun | E05B 81/00 70/91 |
| 2014/0203572 | A1 * | 7/2014 | Barmscheidt | E05B 77/28 292/200 |
| 2015/0284977 | A1 * | 10/2015 | Barmscheidt | E05B 81/14 292/200 |

FOREIGN PATENT DOCUMENTS

| | | |
|---|---|---|
| WO | WO 2013/127381 A2 | 9/2013 |
| WO | WO 2014/059966 A2 | 4/2014 |

OTHER PUBLICATIONS

Machine Translation by Lexis Nexis Total Patent of WO0231298A1 on Jun. 18, 2015.
Machine Translation by Lexis Nexis Total Patent of WO2013127381A2 on Jun. 18, 2015.
Machine Translation by Lexis Nexis Total Patent of WO2014059966A2 on Jun. 18, 2015.

* cited by examiner

MOTOR VEHICLE DOOR LOCK

CROSS-REFERENCE TO RELATED APPLICATIONS

This application is the U.S. national stage application of International Patent Application No. PCT/DE2013/000702, filed Nov. 22, 2013, which claims priority of German Application No. 10 2012 111 288.6, filed Nov. 22, 2012, which are both hereby incorporated by reference.

BACKGROUND

The invention relates to a motor vehicle door lock, comprising a locking mechanism and an electric drive for electric opening of the locking mechanism.

A motor vehicle door lock based on the described design is, for instance, disclosed in WO 02/31298 A1 of the applicant. This prior art embodiment not only allows electric opening of the locking mechanism but also provides a mechanical connection between an actuating lever and the locking mechanism for emergency opening of the locking mechanism. In this context this is also referred to as so-called temporary crash redundancy (TCR). This means that also in a so-called emergency operation or an emergency opening, such as in case of a crash, it is ensured that the locking mechanism can be opened, i.e. with the aid of the actuating lever.

Electric opening of a locking mechanism by means of the electric drive is generally accomplished in such a way that an operator activates, for instance, an external door handle or also an internal door handle. This regularly results in an actuation of a switch, interpreted as an opening request and causing the electric drive to be energized for electric opening of the locking mechanism. In order to, already at this point, prevent incorrect energizing from the outset, blocking elements are increasingly often used in practical application. The electric drive is mechanically secured with the aid of such a blocking element. In order to initiate electric opening of the locking mechanism, the external or internal door handle does, in the example, not only ensure that a switch is activated. Instead, this procedure also corresponds to the blocking element releasing the electric drive so that it can act on the locking mechanism to open it. Although this has generally proven to be successful, mechanically complex solutions are often used at this point.

SUMMARY

For this reason the invention is based on the technical problem of further developing such a motor vehicle door lock in such a way that a particularly compact and simple actuation mechanism for electric opening is provided.

In order to solve this technical problem, a generic motor vehicle door lock of the invention is characterized by an additional drive being provided, releasing a mechanical safety mechanism of the electric drive by said blocking element for electric opening of the locking mechanism with the aid of the electric drive.

The invention thus first of all provides an additional drive used in addition to the electric drive for the actual electric opening. This additional drive ensures that a previously engaged mechanical safety mechanism is released for electric opening of the locking mechanism. This mechanical safety mechanism of the electric drive used for electric opening, is regularly designed in such a way that the blocking element secures the electric drive. The blocking element is therefore generally a blocking lever that can be pivoted around an axis. The blocking lever generally contains at least one blocking lug, stopping the electric drive in the event of incorrect energizing and without acting on an associated actuating lever.

As the invention provides the additional drive, electric opening can be initiated by remote control without problem. This means that mechanical impinging of the door handle is not (no longer) required. In addition, the motor vehicle door lock of the invention can be opened by an emergency opening mechanism in the event of a crash, by purely mechanical means. For this purpose, the drive for electric opening of the locking mechanism ensures during emergency operation that an actuating lever chain is unlocked and that thus a continuous mechanical connection of a door handle up to the locking mechanism is provided.

BRIEF DESCRIPTION OF THE DRAWINGS

Further advantageous embodiments are described in the sub claims. Below, the invention is explained with reference to a drawing, showing just one embodiment; in which:

DETAILED DESCRIPTION OF THE DRAWINGS

The figures show a motor vehicle door lock, containing as usual a not explicitly shown locking mechanism essentially comprising a rotary latch and pawl. An actuating lever 1, mounted together with a blocking element or blocking lever 2 around a common axis 3 in a housing G, acts on the locking mechanism. A rotary movement of the actuating lever 1 around its axis 3 causes the locking mechanism to be opened. For this purpose, the actuating lever 1 acts on a pawl of the locking mechanism in such a way that the pawl is lifted off the associated rotary latch and that the rotary latch is opened with the aid of a spring.

Figure 1:
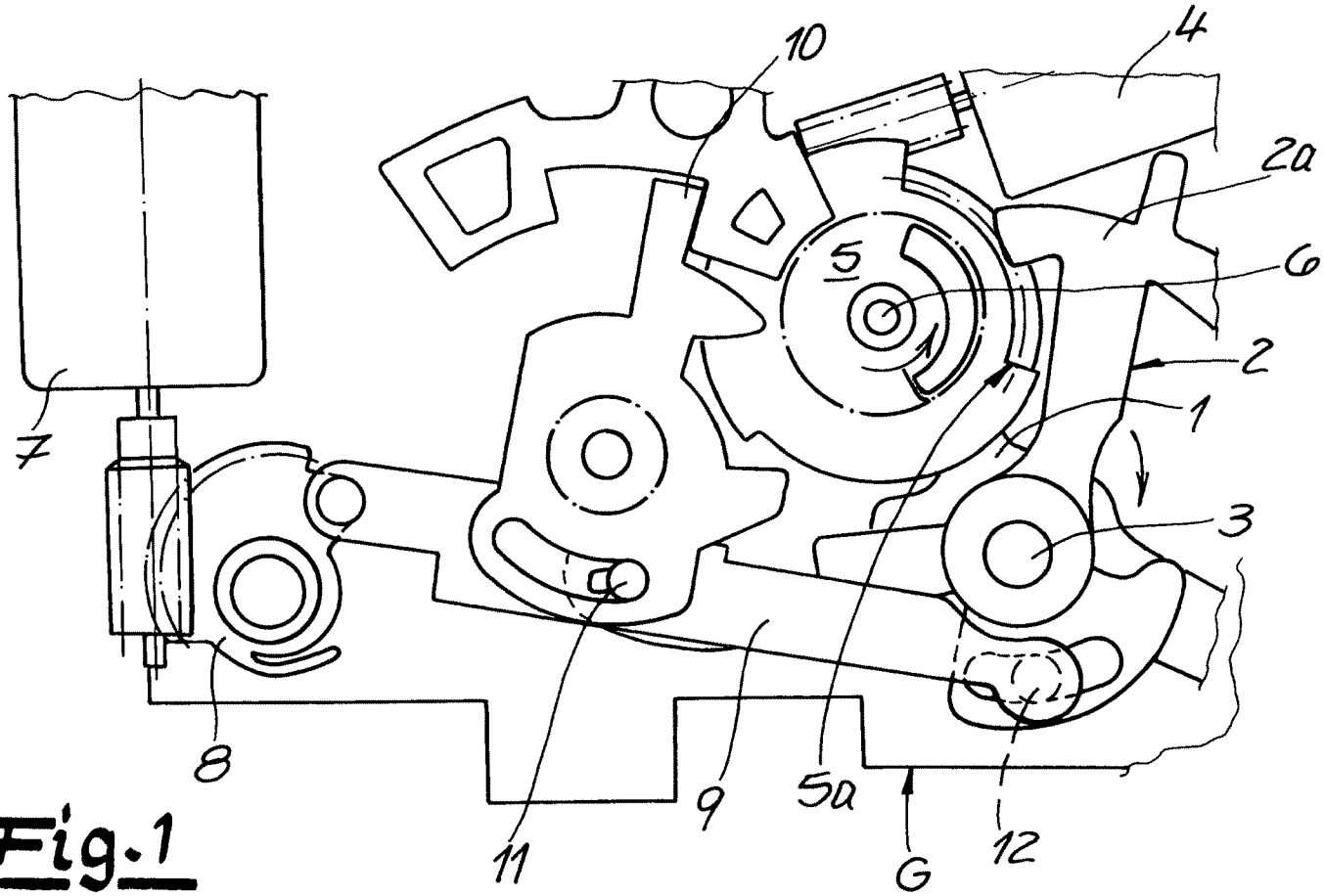
FIG. 1 shows the motor vehicle door lock of the invention with a blocking element in its securing position and an additional drive in the "off" position.

An electric drive 4, 5 is provided in order to initiate clockwise movement of the actuating lever 1 as indicated in FIG. 1. The electric drive 4, 5 essentially consists of an electric motor 4 and a driven pulley 5.

On the output side, the electric motor 4 contains a worm gear meshing with the driven pulley 5 on its periphery. The driven pulley 5 can thus move around its associated axis 6 in clockwise and counter-clockwise direction. An electric opening of the locking mechanism corresponds to the counter-clockwise movement of the driven pulley 5 around its axis 6 as indicated in FIG. 1. This counter-clockwise movement causes a contour, arranged below the driven pulley 5 when viewed from the top as in FIG. 1, to interact with the actuating lever 1 and act on said lever in the manner described and in such a way that the actuating lever 1 carries out the described clockwise rotation around its axis 3 in order to open the locking mechanism. A clockwise movement of the driven pulley 5 initiates an emergency opening by "unlocking" the entire actuating lever chain.

In addition to said electric drive 4, 5 for electric opening of the locking mechanism, the invention also provides a further drive 7, 8. This further drive 7, 8 is another electric motor 7, acting on a driven pulley 8. Fort his purpose a worm gear is provided that is pushed onto a drive shaft of the electric motor 7 or is connected to the drive shaft and meshes with the driven pulley 8. In the example, the additional further drive 7, 8 is a child lock drive and/or an anti-theft drive, as explained in detail below.

With the aid of this additional drive 7, 8 a mechanical safety mechanism of the electric drive 4, 5 for electric opening of the locking mechanism can be released. This mechanical safety mechanism of the electric drive 4, 5 is provided in form of the already described blocking element 2. During operation, a blocking lug 2*a* of the blocking element 2 in form of a blocking lever 2 engages with the driven pulley 5 of the electric drive 4, 5 for electric opening of the locking mechanism.

Figure 2:
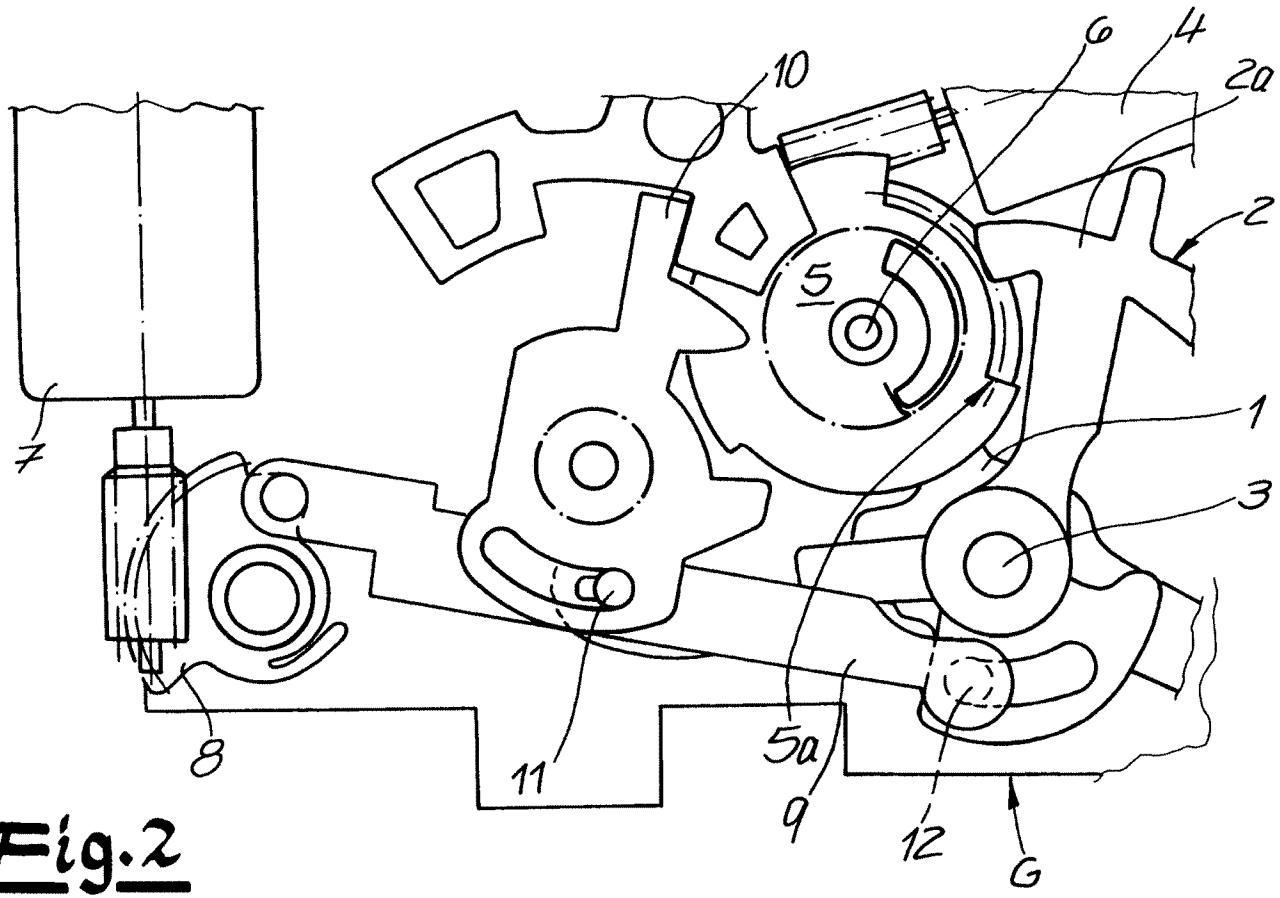
FIG. 2 shows the object of FIG. 1 during the transition of the additional drive into its "on" position and FIG. 3 shows the object of FIG. 2 with the additional drive in its "on" position and the blocking element being in the released position.

If for instance, the electric drive 4, 5 is incorrectly energized and starts to move in the direction of the an electric opening of the locking mechanism (counter-clockwise movement of the driven pulley 5), the blocking element essentially shown in its securing position in FIGS. 1 and 2 or the blocking lever 2 ensures that the electric drive 4, 5 cannot open the locking mechanism. The opening movement of the respective electric drive 4, 5 corresponds to a stop edge 5*a* on the driven pulley 5 moving against the blocking lug 2*a* of the blocking lever 2. In this way, the movement of the electric drive 4, 5 in the direction of an opening movement of the locking mechanism is stopped and the electric drive 4, 5 can as a whole not act on the actuating lever 1 in such a way that the locking mechanism is being opened. In this way any incorrect energizing of the electric drive 4, 5 for electric opening of the locking mechanism is cancelled out or does not cause unintentional opening of the locking mechanism.

As part of the invention, the blocking lever 2 can, for instance, be mechanically removed from its engagement in the electric drive 4, 5 for electric opening of the locking mechanism. For this purpose, the blocking lever 2 only has to be pivoted around its axis 3 in clockwise direction so that the blocking lever 2 leaves its securing position essentially shown in FIGS. 1 and 2 and moves into the release position as shown in FIG. 3.

Apart from this essentially mechanical release of the blocking element or blocking lever 2, the invention also allows an essentially remotely controlled release. This is achieved by means of the additional drive 7, 8. The additional drive 7, 8 does, indeed, not only ensure that the blocking element 2 is acted upon. Instead, the additional drive 2, 3 also acts as an engaging drive for a child lock or anti-theft device, as explained in more detail below.

Particularly significant for the invention is the fact that the additional drive 7, 8 acts and can act on the blocking element 2. For this purpose, the additional drive 7, 8 acts on a connecting lever 9. In the embodiment, the connecting lever 9 is, on one hand, mechanically coupled to a locking lever 10, described below and, on the other hand, to the blocking element or blocking lever 2. The connecting lever 9 actually contains a locking bolt 11 engaging in the recess of the locking lever 10. The connecting lever 9 also contains a blocking bolt 12, engaging in a recess in the blocking element or blocking lever 2.

Figure 3:
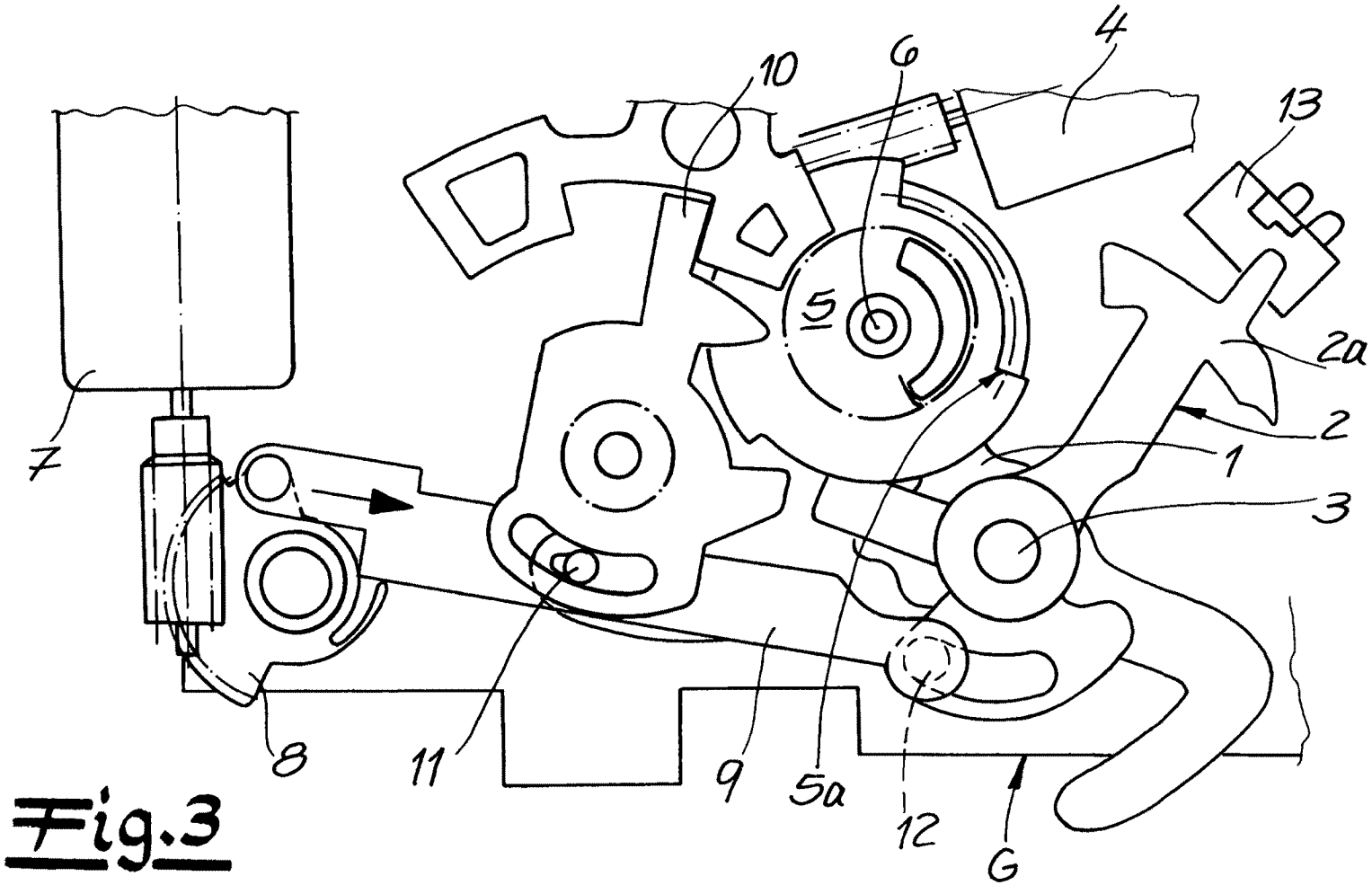

If the additional drive 7, 8 is moved from the "child lock off" position shown in FIG. 1 through the position shown in FIG. 2 into the position "child lock on" as shown in FIG. 3, the connecting lever 9 flexibly connected to the driven pulley 8, ensures that the connecting lever 9 moves the blocking element or the blocking lever 2 in clockwise direction around its axis 3 by means of the blocking bolt 12. As a result, the blocking lever of the blocking element 2 leaves its engaging position shown in FIG. 1 and assumes the released position shown in FIG. 3. During this process, the blocking lever 2 also ensures that a switch is activated and signals the respective release position of the blocking lever 2 to a control unit not shown. The signal of the switch 13 functions as an opening signal for the drive 4, 5.

The additional drive 7, 8 functions, as already explained, also as a safety drive for a child lock. In the position "child lock off" as shown in FIG. 1, the locking lever 10 is in its "locked" position ". In contrast, the functional position according to FIG. 3 corresponds to the additional drive 7, 8 in being in the "child lock on" position. In both cases the locking lever 10 assumes its "locked" position, can however be pivoted into its "released" position as shown in FIG. 3.

As soon as the blocking lever 2 has acted on the switch 13, this signal is interpreted by the control unit in such a way that the electric drive 4, 5 can be acted upon for electric opening of the locking mechanism (opening signal). After the additional drive 7, 8 has reached its position shown in FIG. 3, it is returned by means of a spring. For this purpose, the driven pulley 8 of the additional drive 7, 8 contains a respective spring. This return movement by means of the spring is indicated by an arrow in FIG. 3 indicating movement of the connecting lever 9 in the direction of its base position according to the position shown in FIG. 1.

The invention claimed is:

1. A motor vehicle door lock, comprising:

a locking mechanism and a first electric drive adapted for electric opening of the locking mechanism, and a second electric drive adapted to release a mechanical safety mechanism, the mechanical safety mechanism comprising a blocking element, the mechanical safety mechanism blocks operation of the first electric drive by moving the blocking element from a blocking position that blocks operation of the first electric drive to an unblocking position that does not block operation of the first electric drive for electric opening of the locking mechanism with the aid of the first electric drive;

wherein the second electric drive acts on a locking lever via a connecting lever, and the second electric drive acts on the blocking element via the connecting lever, such that the second electric drive is mechanically coupled to, on one hand, the locking lever by means of the connecting lever, and the second electric drive is mechanically coupled to, on the other hand, the blocking element by means of the connecting lever; and wherein the connecting lever contains a locking bolt engaging in a recess of the locking lever.

2. The motor vehicle door lock according to claim 1, wherein the second drive does not only act on the blocking element but also acts as a securing drive for a child lock or an anti-theft device.

3. The motor vehicle door lock according to claim 1, wherein the second drive contains an electric motor and a driven pulley acted on by said drive.

4. A motor vehicle door lock, comprising:

a locking mechanism and a first electric drive adapted for electric opening of the locking mechanism, and a second electric drive adapted to release a mechanical safety mechanism, the mechanical safety mechanism comprising a blocking element, the mechanical safety mechanism blocks operation of the first electric drive by moving the blocking element from a blocking position that blocks operation of the first electric drive to an unblocking position that does not block operation of the first electric drive for electric opening of the locking mechanism with the aid of the first electric drive;

wherein the second electric drive acts on a locking lever via a connecting lever, and the second electric drive acts on the blocking element via the connecting lever, such that, the second electric drive is mechanically coupled to, on one hand, the locking lever by means of the connecting lever and the second electric drive is mechanically coupled to, on the other hand, the blocking element by means of the connecting lever; and wherein the connecting lever contains a locking bolt engaging in a recess of the blocking element.

5. The motor vehicle door lock according to claim 1, wherein the blocking element is a blocking lever.

6. The motor vehicle door lock according to claim 1, wherein the blocking element assumes a safety and a release position.

7. The motor vehicle door lock according to claim 1, wherein the blocking element contains a blocking lug, which in the safety position interacts with a stop edge of the electric drive in order to block it.

8. The motor vehicle door lock according to claim 2, wherein the second drive contains an electric motor and a driven pulley acted on by said drive.

9. A motor vehicle door lock, comprising:

a locking mechanism and a first electric drive adapted for electric: opening of the locking mechanism, and a second electric drive adapted to release a mechanical safety mechanism, the mechanical safety mechanism comprising a blocking element, the mechanical safety mechanism blocks operation of the first electric drive by moving the blocking element from a blocking position that blocks operation of the first electric drive to an unblocking position that does not block operation of the first electric drive for electric opening of the locking mechanism with the aid of the first electric drive;

wherein the second electric drive contains an electric motor and a driven pulley acted on by said second electric drive;

wherein the second electric drive acts on a locking lever via a connecting lever, and the second electric drive acts on the blocking element via the connecting lever, such that the second drive is mechanically coupled to, on one hand, the locking lever by means of the connecting lever and the second electric drive is mechanically coupled to, on the other hand, the blocking element by means of the connecting lever; and wherein the connecting lever contains a locking bolt engaging in a recess of the locking lever.

10. The motor vehicle door lock according to claim 9, wherein the blocking element is a blocking lever.

11. The motor vehicle door lock according to claim 10, wherein the blocking element assumes a safety and a release position.

12. The motor vehicle door lock according to claim 11, wherein the blocking element contains a blocking lug, which in the safety position interacts with a stop edge of the electric drive in order to block it.

13. The motor vehicle door lock according to claim 1, further comprising a first driven pulley, wherein the first electric drive acts on the first driven pulley and wherein the first driven pulley is adapted for opening of the locking mechanism.

14. The motor vehicle door lock according to claim 13, wherein the blocking element is a blocking lever that engages the first driven pulley.

15. The motor vehicle door lock according to claim 14, wherein the block lever comprises a blocking lever that engages a stop edge on the first driven pulley when the blocking element is in the blocking position.

16. The motor vehicle door according to claim 14, further comprising a sensor adapted to detect when the blocking lever is disengaged from the first driven pulley.

17. The motor vehicle door according to claim 16, further comprising a controller that actuates the first electrical drive when the sensor detects that the blocking lever is disengaged from the first driven pulley.

* * * * *